United States Patent [19]

Kingston et al.

[11] Patent Number: 4,729,114

[45] Date of Patent: Mar. 1, 1988

[54] SIGNAL PROCESSING CIRCUIT FOR INSTANTANEOUS FOURIER TRANSFORMATION

[75] Inventors: Samuel C. Kingston, Salt Lake City; Randall J. Mills, Bountiful, both of Utah

[73] Assignee: Unisys Corporation, Blue Bell, Pa.

[21] Appl. No.: 888,674

[22] Filed: Jul. 24, 1986

[51] Int. Cl.[4] ..... G06G 7/19

[52] U.S. Cl. ..... 364/827; 364/822

[58] Field of Search ..... 364/726, 827, 822, 602, 364/604, 824

[56] References Cited

U.S. PATENT DOCUMENTS

| | | | |
|---|---|---|---|
| 4,085,441 | 4/1978 | Fagan | 364/827 |
| 4,531,196 | 7/1985 | Lin | 364/822 X |
| 4,579,125 | 4/1986 | Strobl et al. | 128/731 |
| 4,581,715 | 4/1986 | Hyatt | 364/726 |
| 4,583,190 | 4/1986 | Salb | 364/726 |

*Primary Examiner*—Jerry Smith
*Assistant Examiner*—Charles B. Meyer
*Attorney, Agent, or Firm*—Glenn W. Bowen; Laurence J. Marhoefer

[57] ABSTRACT

A feedback loop circuit that may be used for Fourier Transform analysis, for carrier acquisition, or for other related purposes, sums the inputs signal, passes it through a delay line to provide an output signal, samples a portion of the output signal in a feedback path, mixes the supplied feedback signal with a first oscillator signal that is several times larger than the center frequency of the allowed input signal bandwidths, eliminates the low sideband frequencies of this mixed signal, mixes this signal with a second local oscillator signal, the frequency of which is lower than the frequency of the first local oscillator by approximately the inverse of the delay time of the input signal, filters out the high sideband frequencies of this signal and combines the remaining feedback signal (either by summation or subtraction) with the input signal.

20 Claims, 3 Drawing Figures

SIGNAL PROCESSING CIRCUIT FOR INSTANTANEOUS FOURIER TRANSFORMATION

BACKGROUND OF THE INVENTION

The Fourier Transform (FT) is an indispensable mathematical tool for analyzing the spectrum structure of electrical waveforms that has been implemented with hardware and software in connection with various versions of the Fast Fourier Transform (FFT) technique. The use of the FFT in real-time applications has been limited to relatively low data rates by these techniques.

The present invention is related to a signal processing circuit and technique that is useful for carrier frequency and waveform acquisition techniques, clock recovery, tone excision, doppler measurements and to a new method, called the Instantaneous Fourier Transform (IFT), which derives the transform of a preselected band of frequencies by using analog hardware in a feedback configuration. The disclosed implementation uses conventional elements such as mixers, filters, local oscillators, and delay lines.

When IFT is compared with four of the more commonly used prior art transform techniques, it is found that there are advantages associated with this technique.

(1) Compared to a chirp transform or an acousto-optical transform, the IFT provides orders of magnitude better resolution with a much simpler design.

(2) Compared to the Fast Fourier Transformer (FFT), the IFT has faster real-time analysis, and requires no sampling or quantization.

(3) Compared to filter bank methods, the IFT is substantially less expensive and generally will have larger time-bandwidth products.

(4) Compared to the scanning radiometers, the IFT usually will be faster by orders of magnitude.

A few of the possible areas of practical application of the circuit of the present invention are for IFT carrier acquisition, data clock frequency recovery, tone excision, waveform acquisition, and doppler measurements. The band of frequencies that are analyzed in IFT can be shifted, widened, or narrowed in bandwidth by minor adjustments to the parameters.

BRIEF DESCRIPTION OF THE DRAWINGS

The present invention is described by reference to the drawings in which.

TECHNICAL DESCRIPTION OF THE INVENTION

The signal processing technique of the present invention may be used to implement an IFT which is a wideband analog technique for calculating the Fourier Transform (FT) of a preselected band of frequencies. It is "instantaneous" in that the transform is available as soon as all inputs are received and no additional time is needed to modify the results. The transform is created by the use of a feedbck loop and takes advantage of the speed at which a mixer can perform complex multiplication. On each pass through a delay line the accumulated result is given a phase shift which linearly increases with delay time. This shifted version is fed back and summed with the newly arriving part of the input waveform. As the system runs the transform of the input signal is instantaneously available at the output.

Figure 1:
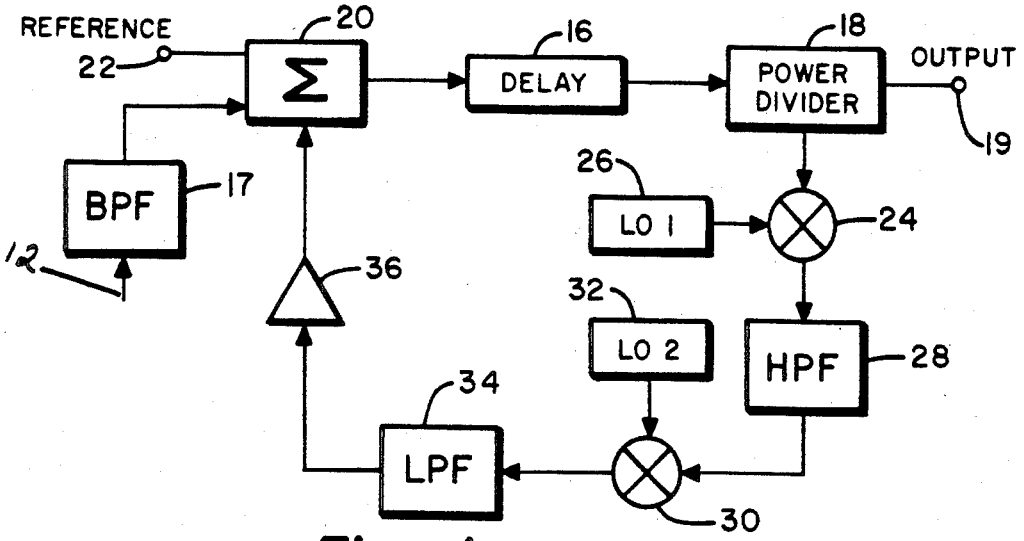
FIG. 1 is a block diagram with a circuit that represents the present invention.

The functional blocks of the IFT device of FIG. 1 include a preselect bandpass filter 17 which defines the bandwidth region for the transform, a delay line 16, a power divider 18, two local oscillators 26, 32, two mixers 24, 30, two zonal filters 28, 34 and one IF amplifier 36.

A feedback loop is formed that includes the local oscillators, the mixers, the zonal filters and the amplifier which builds up the transform with each loop delay time so that an updated version of the transformed input is thus continuously available at the output of the circuit. In the circuit the difference between local oscillator frequencies are close to the inverse loop delay time while the loop gain approaches unity.

The maximum frequency range which can be instantaneously analyzed is limited essentially to the reciprocal of the delay line delay time. The ultimate resolution is limited only by the observation time but practical limitations are set by the loop dispersion free bandwidth, the dynamic rang eand the loop gain and local oscillator stability.

Surface Acoustical Wave (SAW) delay lines with delay times of about 20 microseconds and nondispersive bandwidths on the order of 50 MHz could instantaneously cover 50 KHz of spectrum with approximately 50 Hz resultion. (This range is well-suited to many carrier recovery problems.) Alternately fiber optic, or other types of delay lines, could be used. For wider frequency ranges possible long lengths of coaxial cable may be suitable. For smaller frequency ranges where higher resolution is desired, complex baseband delays digital techniques could be used, but in this case a tradeoff in performing complex baseband multiplications, or converting to IF and mixing must be made. For frequency range/resolution ratios of 100, or less, manual adjustment of the loop gain and local oscillator, frequency should be adequate. The short term drift of these parameters may require closed loop control techniques as the desired processing gain increases.

Mathematically, the output O(t+T) of the IFT device after a time NT may be represented by:

$$O(t+T) = Re\left[\sum_{n=0}^{N} K^n x(t-nT)\exp\left[j\left(W_o(t-nT) + \sum_{i=0}^{n-1} d(t-jT) + \phi\right)\right]\right]$$

$$= Re\,\Sigma\, K^n x(t-nT)\exp[j(W_o(t-nT))]\exp\left[jn\left(dt + \phi + \frac{n-1}{2}dT\right)\right]$$

where:

Re indicates the real part of a complex variable K is the open loop gain x(t) is the complex baseband modulation $W_o$ is the carrier in rad/sec d is the rad/sec difference between L0 1 L0 2 and $\phi$ is the arbitrary phase difference at t=0 between L0 1 and L0 2

If ndT is sufficiently close to $2\pi n$ and K is sufficiently close to unity, the output waveform at time t approximately represents the discrete Fourier frequency transform of the N+1 samples over the time period (t−NT to t) with a frequency of (dt+$\phi$/T modulo$2\pi$/T). If K is less than but close to unity, earlier samples are given less weight. In this case the device can operate continuously as a contiguous filter bank with bandwidth determined by the gain K.

A circuit which may be used to implement the present invention is shown in FIG. 1. The input waveforms supplied to the preselection filter 17 is processed so that the filter 17 eliminates signals outside of the bandpass of the signals to be analyzed. Input line 12 supplies a composite input signal to the filter 17. The output of the filter 17 is supplied to a summing circuit 20 and the output of the summing circuit 20 is fed to a delay line 16. A fraction of the output signal from the delay line 16 is supplied through the power divider 18 to the output terminal 19, and a portion is supplied to the mixer 24.

A local oscillator 26 is also supplied to the mixer 24 which is at a stable frequency that preferably is at least five or six times greater than the expected highest frequency of the bandpass filter. The mixed signal from the mixer 24 is then supplied through a high pass filter 28, which eliminates any lower sideband frequencies, to a second mixer 30.

The second mixer 30 is also coupled to a second local oscillator 32 which is at a stable frequency that is lower than the frequency of the oscillator 26 by an amount which is approximately equal to the inverse of the delay time of the delay line 16. This difference in frequency also is equal approximately to the maximum frequency which can be instantaneously analyzed or acquired by the circuit, and also to the bandwidth of the filter 17. For example, if the delay time of the delay line 16 is one microsecond, than the bandwidth will be 1 MHz, which will also be equal to the difference in the local frequencies of the local oscillators 26 and 32.

The output of the mixer 30 is then coupled to the low pass filter 34 which eliminates the upper sideband frequencies of the signal from the mixer 30. The signal that is passed through the low pass filter 34 is, therefore, related to the frequency difference of the local oscillators 26, 32. For example, if the input center frequency to the bandpass filter 12 is 20 MHz and the local oscillator 26 is 120 MHz, the signal that appears as the output of the mixer 24 will show peaks at 100 MHz and 140 MHz. The high pass filter 28 will eliminate the 100 MHz signal. The mixing that occurs at the mixer 30, when the local oscillator 32 is at, for example, 119 Mhz, will then result in signals with peaks at 21 MHz and 259 MHz.

The signal that is passed through the low pass filter 30 will then show at peak at 21 MHz. The signal from the low pass filter 34 is next passed through an IF amplifier 36 to a second input of the summer 20. The output from the bandpass filter 17 will then be peaked at 20 MHz, while the output from the amplifier 36 will be peaked at 21 MHz. However, each time that the signal is passed through the delay line 16, through the power divider 18 and back through the loop and the amplifier 36 to the summer 20, there is in effect a shifting of energy to higher and higher frequency signal components at approximately 1 MHz spacings until the signal is significantly attenuated.

Figure 2:
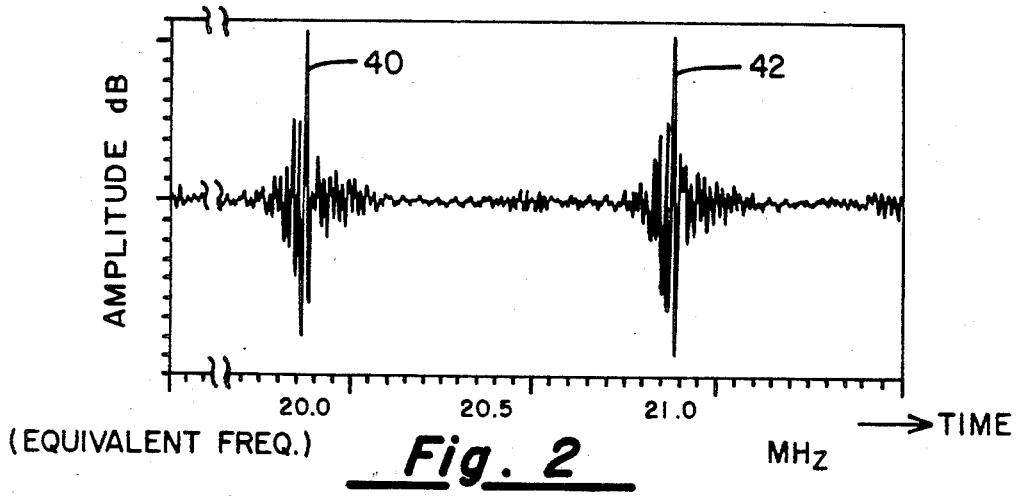
FIG. 2 is a waveform representation of the output of the circuit of FIG. 1 having a single tone input signal where the amplitude of the output is plotted in decibels vs. time.

The output of the IFT device although a function of time can also be interpreted as a frequency variable. As the time continues to increase, the output can be viewed as sweeping through the band of frequencies covered by the preselection filter 17. The effect of the operation of the described circuit on a single sinusoidal input signal is shown in FIG. 2, where the first peak 40 represents a single sinusoidal input frequency of 20 MHz. As the time increases (1 $\mu$sec) the output sweeps through the bandwidth of the preselection filter, 1 MHz in this case, (from 20 to 21 MHz) and then cycles back in frequency to the 20 MHz peak 42 and begins another sweep across the bandwidth. Thus as the system runs, time continues to increase, and the output repeatedly "traces" through the frequency range covered by the preselection filter 17.

Figure 3:
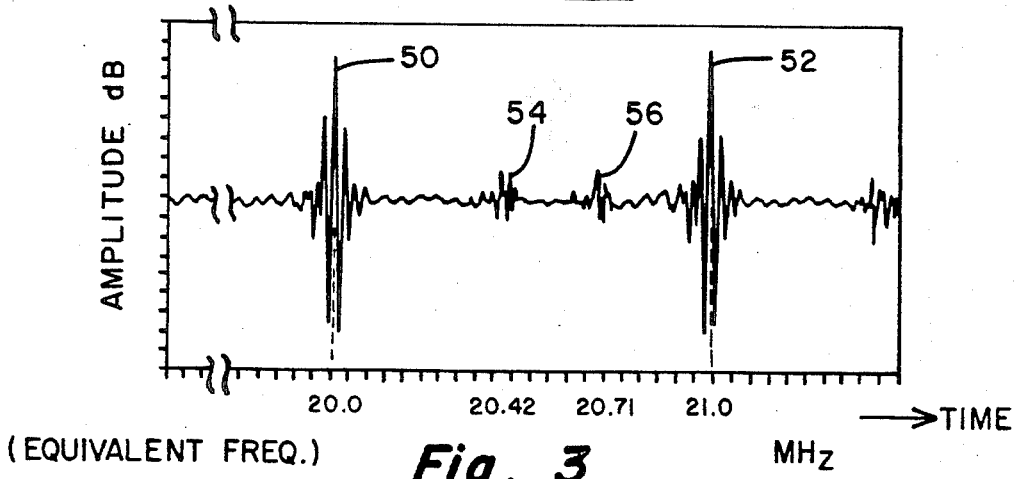
FIG. 3 is a waveform representation similar to FIG. 2, but with a reference marker signal input and two signals combined to form a composite input signal.

The system may also be used with a reference tone signal applied as a marker by applying a signal to the reference line 22 to the summer 20. FIG. 3 shows the marker signal as represented by the large peak signals 50 and 52, while the input signal consisting of two tones is indicated by the peaks 54 and 56. The two tones are both higher in frequency than the reference tone, but less than the reference frequency tone plus the reciprocal of the time delay of the delay line 16. Thus the mark 54 indicates a reference frequency of approximately 20.42 MHz while the reference signal 56 indicates a frequency of approximately 20.71 MHz.

While the loop gain should be held approximately at unity to obtain maximum resolution, if the gain is slightly decreased, earlier inputs that are further in the past are de-emphasized, or "forgotten". This aspect may be advantageous in situations where only the latest input information is desired, or where the user wishes to scan across a wide spectrum of frequencies.

The ultimate resolution of the system is limited by the observation time, so that the longer the delay of the delay line 16, the narrower is the bandwidth of the circuit and the higher is the resolution. Practical limitations of the resolution are limited, however, by the feedback loop dispersion free bandwidth, the stability of the local oscillators and the loop gain stability.

The present invention, provides a highly reliable, relatively low cost system that provides real-time Fourier Transformations, carrier and waveform acquisition, clock frequency recovery tone excision, doppler meeasurements and other purposes. Modifications obvious to those skilled in the art and within the scope of the claims are intended to be included in the coverage of this patent.

In particular it is noted that the local oscillator 32 may precede the local oscillator 26 in the feedback path os that the output of the mixer 24 would peak at 139 MHz and 89 MHz and output of the mixer 30 at 19 MHz and 139 MHz. The element 20 in this instance would subtract the signal from the amplifier 36 from the signal from the filter 17. Band elimination filters and other filter arrangements known to those skilled in the art may be substituted for the specific filters disclosed within the scope of the present invention. The term zonal filter as used herein is intended to include band passing or band blocking filters as appropriate for the frequency zone that is passed or blocked in the intended application.

What is claimed is:

1. A signal processing circuit comprising an input means for receiving an input signal, combining means having a plurality of inputs coupled for receiving said input signal from said input means on one of its inputs and for supplying a combined signal, delay means coupled to receive said comdined signal from said combining means for delaying said combined signal for a predetermined time and for providing a delayed signal, power dividing means coupled to receive said delayed signal from said delay means and for supplying an output signal and a feedback signal, output means coupled to said power dividing means coupled for receiving said output signal, first mixing means coupled to said power dividing means for receiving said feedback signal, first local oscillator means coupled to supply a first oscillator signal to said first mixing means, said first mixing means being constructed to supply a first mixed signal comprising said feedback signal and said first oscillator signal, a first zonal filter means coupled to receive said first mixed signal and for supplying a first filtered signal, second mixing means coupled to said first zonal filter for receiving said first filtered signal, second local oscillator means coupled to supply a second oscillator signal to said second mixing means, said second mixing means being constructed to supply a second mixed signal comprising said first filtered signal and said second oscillator signal, second zonal filter means coupled to receive said second mixed signal from said second mixing means and for supplying a second filtered signal and coupling means for coupling said second mixed signal to a second input terminal of said combining means, wherein a frequency difference exists between said first and second oscillator means which is approximately equal to the inverse of the delay time between said input signal and said delayed signal.

2. A circuit as claimed in claim wherein said input means comprises preselection bandpass filter means which has a bandwidth that is approximately equal to said frequency difference between said first and second said local oscillator means.

3. A circuit as claimed in claim 2 wherein said bandpass filter means filters said input signal, and where said bandpass filter means has a center frequency, wherein said frequencies of both said first and second local oscillator means are several times greater than the center frequency of said bandpass filter means.

4. A circuit as claimed in claim 3 wherein said combining means further includes a third input terminal and a reference signal is supplied to said third input terminal of said combining means.

5. A circuit as claimed in claim 4 wherein said input means comprises an input combining means and a plurality of source signals are combined in said input combining means to develop said input signal.

6. A circuit as claimed in claim 5 wherein one of said first and second zonal filter means is a high pass filter and the other is a low pass filter.

7. A circuit as claimed in claim 1 wherein said combining means further includes a third input terminal and a reference signal is supplied to said third input terminal of said combining means.

8. A circuit as claimed in claim 1 further comprising a bandpass filter means for filtering said input signal, said bandpass filter means having a center frequency wherein said frequencies of both said first and second local oscillator means are several times greater than the center frequency of said bandpass filter means.

9. A circuit as claimed in claim 1 wherein said input means comprises an input combining means and a plurality of source signals are combined in said input combining means to develop said input signal.

10. A circuit as claimed in claim 1 wherein one of said first and second zonal filter means is a high pass filter and the other is a low pass filter.

11. A method of signal processing comprising supplying first and second local oscillator signals, delaying an input signal for a predetermined time, sampling a first portion of said delayed input signal as an output signal, sampling a second portion of said delayed input signal as a feedback signal, mixing and filtering said feedback signal in a serial manner to generate a loop output signal, wherein a first mixed signal is supplied by one of said first and second local oscillator signals and a second mixed signal is supplied by the other of said first and second local oscillator signals, wherein said local oscillator signals have a frequency difference that is approximately equal to the inverse of the delay time of said delayed input signal, and combining a source signal and said loop output signal to provide said input signal.

12. A method as claimed in claim 11 further comprising combining a reference signal with said source signal and said loop output signal.

13. A method as claimed in claim 11 further comprising combining a plurality of independent signals to provide said source signal.

14. A method as claimed in claim 11 further comprising band pass limiting said source signal to a predetermined bandwidth that is approximately equal to the frequency difference of said first and second local oscillator signals.

15. A method as claimed in claim 11 further comprising controlling the frequencies said first and second local oscillator signals so they are several times greater then the center frequency of said bandwidth.

16. A method as claimed in claim 11 further further comprising filtering one of said mixed signals with a high pass filter means and the other of said mixed signals with a low pass filter means.

17. A method as claimed in claim 16 further comprising combining a plurality of independent signals to provide said source signal.

18. A method as claimed in claim 17 further comprising band pass limiting said source signal to a predetermined bandwidth that is approximately equal to the frequency difference of said first and second local oscillator signals.

19. A method as claimed in claim 18 further comprising controlling the frequencies said first and second local oscillator signals so they are several times greater then the center frequency of said bandwidth.

20. A method as claimed in claim 19 further comprising combining a reference signal with said source signal and said loop output signal.

* * * * *